US007147552B2

(12) United States Patent
Schimpl

(10) Patent No.: US 7,147,552 B2
(45) Date of Patent: Dec. 12, 2006

(54) APPARATUS FOR SEPARATING COINS

(75) Inventor: Johannes Schimpl, Alberndorf (AT)

(73) Assignee: Novotech Elektronik Gesellschaft m.b.H., Gallneukirchen (AT)

( * ) Notice: Subject to any disclaimer, the term of this patent is extended or adjusted under 35 U.S.C. 154(b) by 165 days.

(21) Appl. No.: 10/864,000

(22) Filed: Jun. 9, 2004

(65) Prior Publication Data

US 2005/0277378 A1 Dec. 15, 2005

(51) Int. Cl.
*G07D 1/00* (2006.01)

(52) U.S. Cl. ..... 453/18; 453/56; 221/254

(58) Field of Classification Search ..... 453/18, 453/3, 29, 56; 198/373, 406, 618, 629, 717; 209/911, 917, 691, 692, 696, 707, 1, 509, 209/606, 625, 628, 635; 271/18, 34; 232/56; 221/254, 158, 159, 171

See application file for complete search history.

(56) References Cited

U.S. PATENT DOCUMENTS

| | | | | |
|---|---|---|---|---|
| 3,361,141 | A * | 1/1968 | Ernst | 453/11 |
| 3,904,021 | A * | 9/1975 | Schweitzer | 198/360 |
| 3,965,912 | A * | 6/1976 | Gross | 453/56 |

FOREIGN PATENT DOCUMENTS

| | | |
|---|---|---|
| DE | 1 499 552 | 1/1971 |
| DE | 28 43 859 | 4/1979 |
| GB | 1 386 304 | 3/1975 |
| WO | WO 94/04996 | 3/1994 |

* cited by examiner

*Primary Examiner*—Patrick Mackey
*Assistant Examiner*—Mark J Beauchaine
(74) *Attorney, Agent, or Firm*—Collard & Roe, P.C.

(57) ABSTRACT

An apparatus is described for separating coins (1) whose diameter and thickness lie within predetermined magnitudes, with a coin funnel (12), with at least one revolving coin conveyor (3) whose conveying strand which rises in the conveying direction and leads upwardly out of the coin funnel (12) forms a part of the rear wall (13) of the coin funnel (12) and comprises coin receivers for individual coins (1), with an ejector device for coins (1) axially lying above one another in the coin receivers and with a removal device (24) for the separated coins (1). In order to provide advantageous constructional conditions it is proposed that the coin conveyor (3) consists of two commonly driven, continuous traction means (7) which extend parallel in the region of the conveying strand on either side of a sliding web (8) for the coins (1), and the coin receivers consist of carrier pins (9) which are provided on the traction means (7), are associated with each other in pairs and project beyond the sliding web (8) by a dimension exceeding the predetermined largest coin thickness, and that the sliding web (8) carries a run-on ramp (20) as an ejector device whose height is smaller than the excess portion of the carrier pins (9) over the sliding web (8), but larger than the difference of the excess portion of the carrier pins (9) and the smallest predetermined coin thickness.

7 Claims, 3 Drawing Sheets

APPARATUS FOR SEPARATING COINS

FIELD OF THE INVENTION

The invention relates to an apparatus for separating coins whose diameter and thickness are situated within predetermined magnitudes, with a coin funnel, with at least one revolving coin conveyor whose conveying strand which rises in the conveying direction and leads upwardly out of the coin funnel forms a part of the rear wall of the coin funnel and comprises coin receivers for individual coins, with an ejector device for coins axially lying above one another in the coin receivers and with a removal device for the separated coins.

DESCRIPTION OF THE PRIOR ART

Conventional separating apparatuses for coins comprise a conveying disk in the region of the rear wall of a coin funnel, which disk is provided with receiving holes for the coins. In order to avoid the disadvantages of such disks which upwardly convey the coins separately from the coin funnel, an apparatus for separating coins has already been proposed (DE 28 43 859 A1) in which the conveying disk is replaced by a coin conveyor in the form of a revolving conveyor belt which is provided with receiving holes for individual coins which are conveyed with the conveying strand of the conveyor belt rising in the conveying direction upwardly along a sliding surface out of the coin funnel to a removal device. Said removal device consists of a sloping removal conduit which is provided on the inside of the conveyor belt and is open relative to the conveying strand, so that the coins separated in the receiving holes of the conveyor belt enter through the receiving holes into the removal conduit and are removed for further treatment. Since the thickness of the conveyor belt exceeds the thickness of the coins, two coins which are situated axially above one another can be conveyed out of the coin funnel in the individual receiving holes whose cross section allows receiving merely one coin. For this reason an ejection device in the form of a roller provided with radial ejection fingers is provided for the coins situated above one another in the receiving holes, which roller is driven synchronously with the conveyor belt and engages with the ejection fingers form the inside of the conveyor belt into the receiving holes, so that the coins are lifted from the sliding surface receiving the conveying strand of the conveyor belt to such an extent that any randomly entrained second coin will slide over the edge of the receiving opening and will fall back into the coin funnel. The disadvantageous aspect in this known apparatus for separating coins is however that the secure filling of the receiving holes of the conveyor belt with coins from the coin funnel requires a certain transfer position of the coins, which can only be ensured by a complex configuration of the coin funnel. Moreover, the coins can hardly be aligned with the required precision within the receiving holes in such a way that a simple detection of the coin dimensions is enabled during the removal of the separated coins from the coin funnel. Finally, the known apparatus must be regarded as susceptible for malfunctions because the receiving holes tend to become soiled and foreign bodies reaching the coin funnel can be removed via the conveyor belt without being recognized.

SUMMARY OF THE INVENTION

The invention is thus based on the object of providing an apparatus for separating coins of the kind mentioned above in such a way that the individual coins are securely grasped by the coin conveyor from the coin funnel and are centered in such a way that the coin dimensions can be determined in a sufficiently precise manner during their conveyance from the coin funnel. Moreover, advantageous preconditions for an effective recognition of foreign bodies are to be created.

This object is achieved by the invention in such a way that the coin conveyor consists of two commonly driven, continuous traction means which extend parallel in the region of the conveying strand on either side of a sliding web for the coins and the coin receivers consist of carrier pins which are provided on the traction means, are associated with each other in pairs and project beyond the sliding web by a dimension exceeding the predetermined largest coin thickness, and that the sliding web carries a run-on ramp as an ejector device whose height is smaller than the excess portion of the carrier pins over the sliding web, but larger than the difference of the excess portion of the carrier pins and the smallest predetermined coin thickness.

Since the coin conveyor is formed by two parallel traction means extending on either side of a sliding web for the coins, which traction means are jointly driven and are provided with carrier pins which are arranged mutually in pairs and project beyond the sliding web, a secure entrainment of individual coins by the carrier pins is given in the region of the coin funnel, with the sliding friction between the coins and the sliding web producing a secure resting of the coins on the carrier pins of each pair of carrier pins with the consequence that the coins are displaced in a precisely centered manner along the sliding web between the carrier pins arranged in pairs. The favorable grasping of the coins by the carrier pins requires an excess length of said pins relative to the coin thickness, supporting the entrainment of two axially superimposed coins. In order to ensure the removing conveyance of individual coins only, the sliding web is associated with a run-on ramp used as an ejector device for the coins resting thereon whose height is smaller than the excess portion of the carrier pins over the sliding web, but larger than the difference from said excess portion and the smallest predetermined coin thickness. This means that even when two coins with the smallest predetermined coin thickness rest above one another, the upper coin is lifted via the carrier pins along the run-on ramp and falls back into the coin funnel.

For the purpose of the simple detection of foreign bodies which may cause malfunctions, which means foreign bodies which exceed the coin dimensions, a coin passage can be provided downstream in the conveying direction, which passage is adjusted to the largest predetermined coin diameter and the largest predetermined coin thickness and on which the foreign body which exceeds the cross section of the pass-through opening will impinge, which can be used for a control intervention in order to avoid damage as long as the foreign body is not removed.

Although the conveyance of the coins along the sliding web generally ensures that during the entrainment of a coin which is not held between two carrier pins and does not rest on the sliding web by a subsequent coin grasping between two carrier pins the erroneously conveyed coin is slid away from the sliding web along the circumference of the coin pushing it along and will fall back into the coin funnel, such an erroneous conveyance of coins can be detected in such a way that a sensor set to the largest predetermined coin dimension and used for the coin dimensions measured in the conveying direction is provided downstream of the run-on ramp. If this sensor responds, the dimensions of the conveyed material in the longitudinal conveying direction exceeds the largest predetermined coin diameter, as is the case in the conveyance of two radially adjacent coins. The erroneously conveyed coin can be ejected from the sliding web by means of an ejector provided in the sliding web.

To ensure that the coins grasped by the carrier pins can be removed in an unhindered manner from the coin funnel, it is recommended to choose the mutual distance of the pairs of carrier pins larger than the permitted filling height of the coin funnel, so that the coins which are grasped in a preceding way by the carrier pins are already ejected from the coin funnel when the next coins are entrained by the carrier pins arranged in pairs.

The likelihood of the formation of a bridge in the coin funnel can be countered in a simple manner in such a way that the coin funnel is associated with a vibrating device which is activated when required. For this purpose, a sensor can be arranged in the region of the sliding web directly adjacent to the coin funnel, which sensor detects the entrainment of a coin by each pair of carrier pins and activates the vibrating device briefly on detecting an empty conveyance.

The formation of the coin receivers of the coin conveyor in the form of carrier pins makes the apparatus less susceptible to malfunctions by dirt accumulation. Maintenance is still necessary however, for example for removing foreign bodies from the region of the conveyor. To ensure that the conveying strand of the coin conveyor becomes easily accessible for maintenance work, the coin conveyor can be held in a frame so as to be pivotable about an upper pivoting axis and can be pivoted from a working position to a maintenance position pivoted away from the coin funnel.

Although an even movement of the two revolving traction means is relevant for the movement of the carrier pins, which can be secured with the help of different traction means, especially simple constructional conditions are obtained when the two continuous traction means each consist of a toothed belt for the reason that such toothed belts are less susceptible to dirt accumulation and can be driven in a sufficiently even manner.

BRIEF DESCRIPTION OF THE DRAWINGS

The subject matter of the invention is shown by way of example in the drawings, wherein.

DESCRIPTION OF THE PREFERRED EMBODIMENTS

Figure 1:
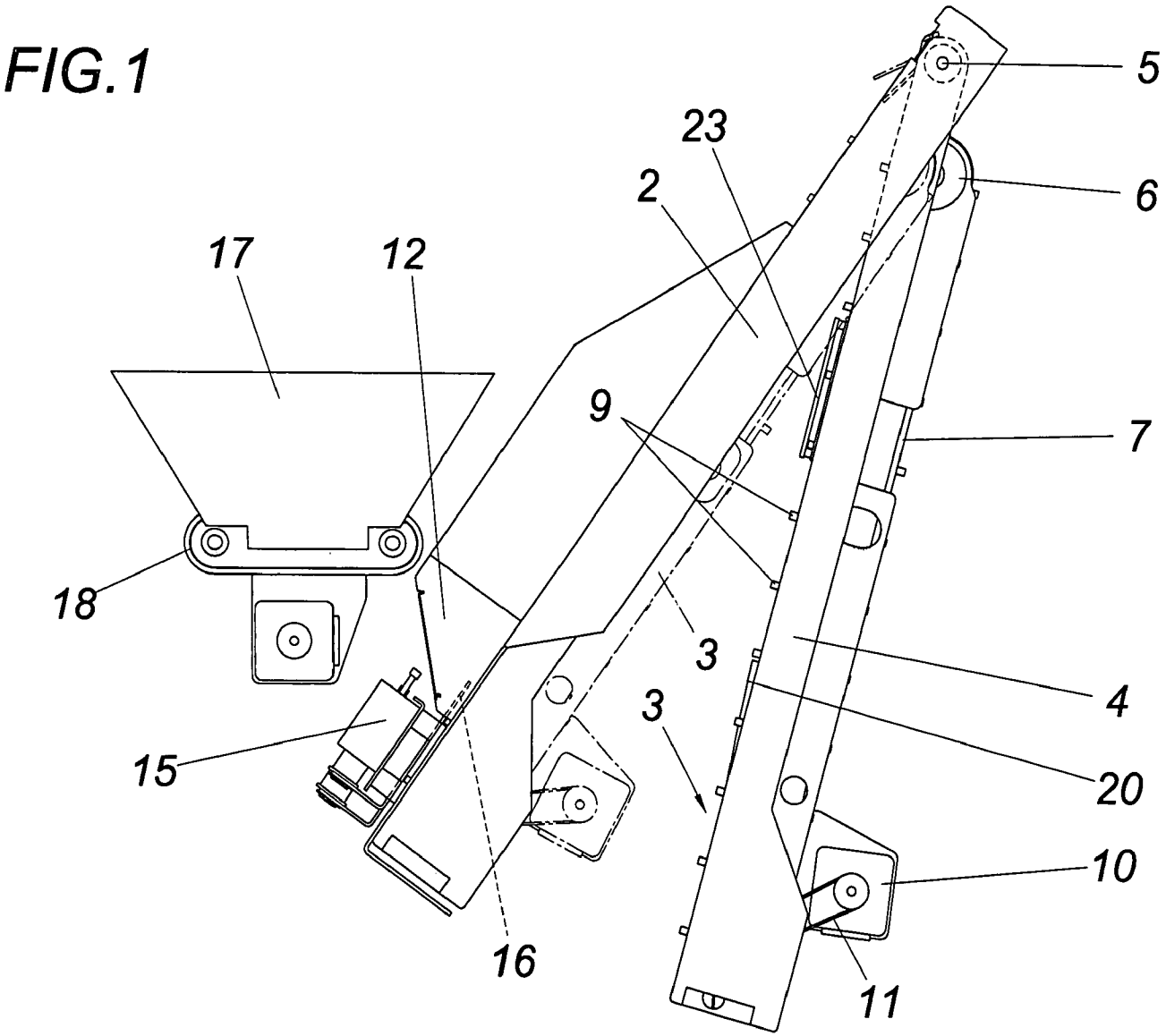
FIG. 1 shows an apparatus in accordance with the invention for separating coins in a simplified side view.

The illustrated apparatus for separating coins 1 comprises a frame 2 which holds two coin conveyors 3 in a housing 4 which can be swiveled about an upper pivoting axis 5 from the outwardly pivoted maintenance position as shown in the unbroken lines to the inwardly swiveled working position as shown with the dot-dash lines in which the housing 4 is latched together with the frame 2. Each coin conveyor 3 comprises two deflection rollers 6 which are arranged as toothed wheels, about which two parallel traction means 7 are guided in a continuous manner. A sliding web 8 for the coins 1 extends between the conveying strand of said two traction means 7 which are preferably configured as toothed belts. The conveying strands of the traction means 7 are slightly offset to the rear relative to said web. The traction means 7 carry mutually paired carrier pins 9 which project beyond the sliding web 8, namely to an extent which exceeds the largest predetermined coin thickness. The coins 1 can therefore be grasped between the carrier pins which are associated with each other on either side of the sliding web 8 and can be displaced along the sliding web 8 which rises in the conveying direction. A motor 10 is used for driving the coin conveyor 3 which drives the lower deflection roller 6 for the traction means 7 via a belt drive 11.

Figure 2:
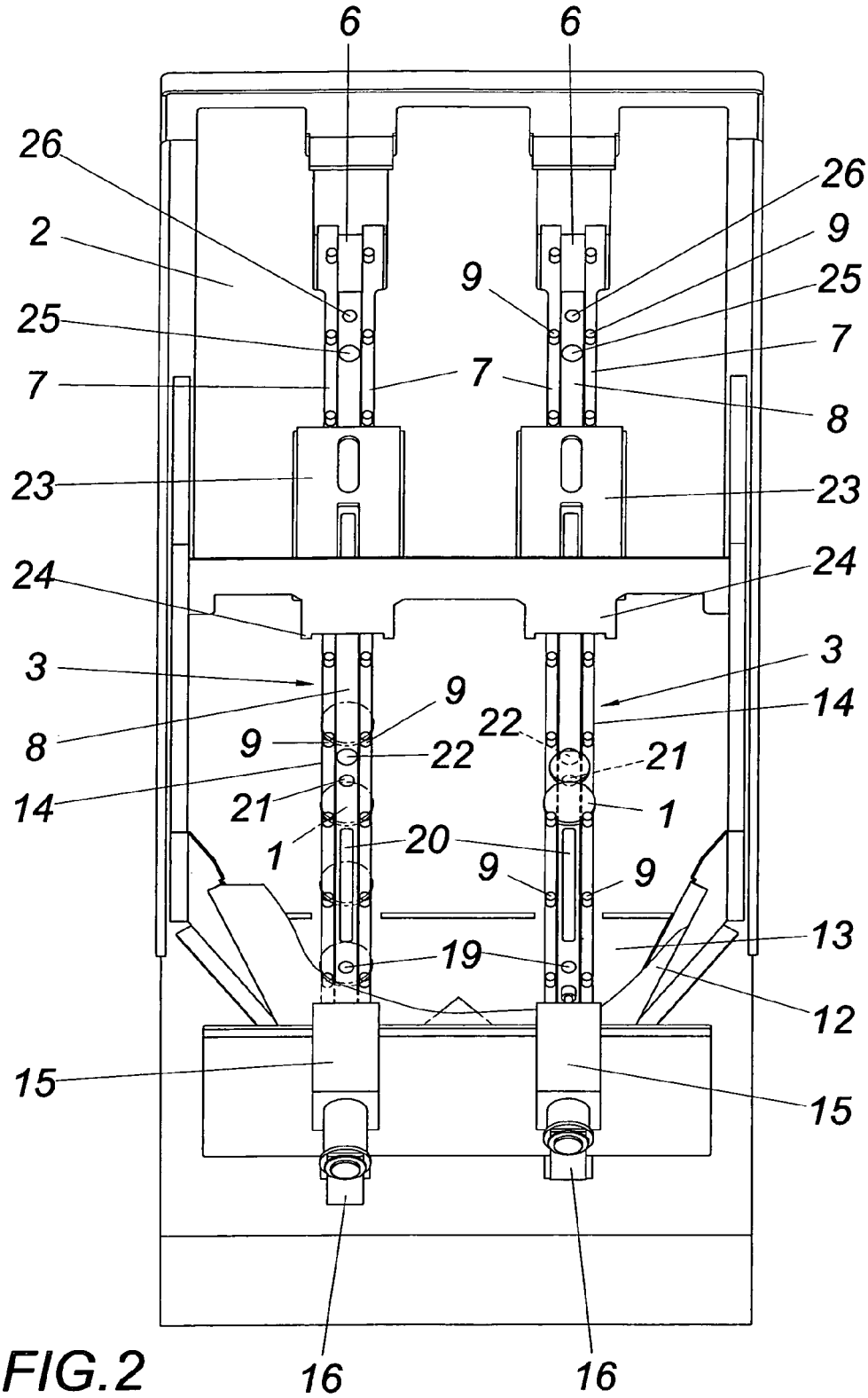
FIG. 2 shows this apparatus in a front view with an elevated sectional view of the coin funnel on an enlarged scale.

The frame 2 carries a coin funnel 12 whose rear wall is formed by the frame and, in the region of the rear wall 13, by at least one coin conveyor 3 which projects through a recess 14 into the coin funnel 12, as is shown in FIG. 2. The coin funnel 12 as carried by the frame 2 is provided with a vibrating device 15. This vibrating device 15 consists of two vibrating magnets for example which are associated with the two coin conveyors 3 and which act upon sliders 16 which project into the coin funnel 2 and are loaded by retracting springs, so that the stock of coins within the coin funnel 12 can be vibrated via said sliders 16 in order to prevent the formation of bridges. A feed container 17 is used for filling the coin funnel 12, from which the coins 1 can be conveyed away by means of a conveyor 18 depending on the respective filling level of the coin funnel 12.

Figures 3, 4:
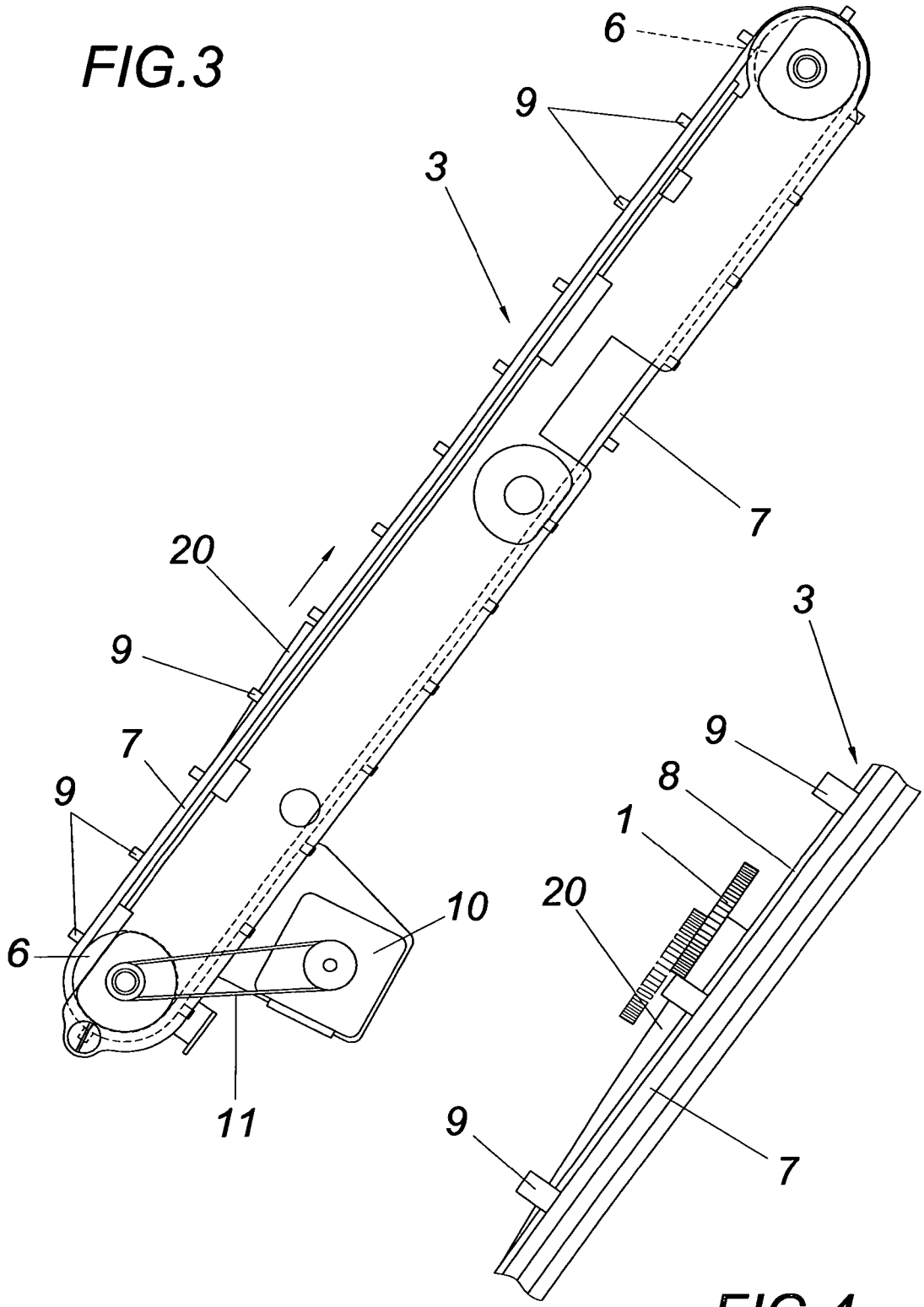
FIG. 3 shows the coin conveyor in a side view on an enlarged scale.
FIG. 4 shows the conveying strand of the coin conveyor in a sectional view in the region of the run-on ramp on an enlarged scale.

The coins 1 received by the coin funnel 12 are grasped by the carrier pins 9 of the coin conveyors 3 and removed upwardly from the coin funnel 12 along the sliding webs 8. A sensor 19 which is provided in the sliding web 8 and responds when no coin is conveyed by the pair of carrier pins monitors the regular conveyance of coins 1 from the coin funnel 12 by the successive pairs of carrier pins. In the case of an empty conveyance it is thus possible to activate the vibrating device 15 in order to support the successive slippage of the coins 1 to be separated. The coins 1 which are grasped by the paired carrier pins 9 are supplied to an ejector device which will convey any coins 1 erroneously resting axially on the separated coin 1 back to the coin funnel 12. This ejector device consists of a run-on ramp 20, as is shown in closer detail in FIG. 4. The run-on ramp 20 has a height which is smaller than the excess portion of the carrier pins 9 over the sliding web 8, but larger than the difference from the excess portion and the smallest predetermined coin thickness, so that every coin resting on a separated coin 1 is lifted along the run-on ramp 20 via the carrier pins 9 and falls back into the coin funnel 12.

An erroneous conveyance of coins 1 is also given in the case that a coin 1 which is held between two carrier pins 9 pushes a further coin along the sliding web 8. In order to detect this case, a sensor 21 is provided which detects the extension of the coins 1 in the longitudinal direction of conveyance and responds when the detected longitudinal extension exceeds the predetermined largest coin diameter. A downstream ejector 22 can be activated via the sensor 21, which ejector is provided in the sliding web 8 and ejects the erroneously conveyed coin 1 from the sliding web 8 back to the coin funnel 12, as can be seen by reference to the right coin conveyor 3 in FIG. 2.

In order to ensure that foreign bodies which exceed the coin dimensions will not cause any damage to the coin detection devices 23 which are associated with the coin conveyors 3, said coin recognition devices 23 are provided upstream with a coin passage 24 whose opening cross section corresponds to the largest predetermined coin diameter and the largest coin thickness, so that all items exceeding these dimensions will impinge on said coin passage 24 and will lead to a control intervention which deactivates the motor 10 for the coin conveyor 3, so that the foreign body can be removed as a result of the malfunction report when the coin conveyors 3 are swiveled outwardly over the housing 4 to the maintenance position. Preferably, the coin conveyors 3 are turned back by a predetermined amount for emptying prior to the pivoting of said coin conveyors 3.

After the coin detection device 23, which comprises in the conventional manner an optical diameter detection and an electromagnetic alloy detection, the detected coins 1 are ejected into a collecting container by way of discharge devices triggered by the respective coin detection device 23, which discharge devices are electromagnetic ejectors for example. Coins 1 that are not recognized also reach a collecting container beyond the ejection end of the respective coin conveyor 3.

The proper ejection of the recognized coins or the conveyance of the unrecognized coins can be monitored by a sensor 26 provided downstream of the discharge device 25.

The invention claimed is:

1. An apparatus for separating coins whose diameter and thickness lie within predetermined magnitudes, with a coin funnel, with at least one revolving coin conveyor whose conveying strand which rises in the conveying direction and leads upwardly out of the coin funnel forms a part of the rear wall of the coin funnel and comprises coin receivers for individual coins, with an ejector device for coins axially lying above one another in the coin receivers and with a removal device for the separated coins, characterized in that the coin conveyor (3) consists of two commonly driven, continuous traction means (7) which extend parallel in the region of the conveying strand on either side of a sliding web (8) for the coins, and the coin receivers consist of carrier pins (9) which are provided on the traction means (7), are associated with each other in pairs and project beyond the sliding web (8) by a dimension exceeding the predetermined largest coin thickness, and that the sliding web (8) carries a run-on ramp (20) as an ejector device whose height is smaller than the excess portion of the carrier pins (9) over the sliding web (8), but larger than the difference of the excess portion of the carrier pins (9) and the smallest predetermined coin thickness.

2. An apparatus as claimed in claim 1, wherein a coin passage (24) which is adjusted to the largest predetermined coin diameter and the largest predetermined coin thickness is provided downstream of the run-on ramp (20) in the conveying direction.

3. An apparatus as claimed in claim 1, wherein a sensor (22) which is adjusted to the largest predetermined coin diameter is provided downstream of the run-on ramp (20) for the coin dimensions measured in the conveying direction.

4. An apparatus as claimed in claim 1, wherein the distance between the pairs of carrier pins (9) is larger than the permitted filling height of the coin funnel (12).

5. An apparatus as claimed in claim 1, wherein a vibrating device (15) is associated with the coin funnel (12).

6. An apparatus as claimed in claim 1, wherein the coin conveyor (3) is held in a frame (2) so as to be pivotable about an upper pivoting axis (5) and can be pivoted from a working position to a maintenance position pivoted away from the coin funnel (12).

7. An apparatus as claimed in claim 1, wherein the two continuous traction means (7) consist of one toothed belt each.

* * * * *